United States Patent [19]

Itayama

[11] 4,102,597

[45] Jul. 25, 1978

[54] VENTILATING SUCTION AND EXHAUST FAN DEVICE OF PLATE TYPE

[75] Inventor: Shinichi Itayama, Osaka, Japan

[73] Assignee: Teizo Sakai, Osaka, Japan

[21] Appl. No.: 782,782

[22] Filed: Mar. 30, 1977

[30] Foreign Application Priority Data

Mar. 31, 1976 [JP] Japan ..... 51-36535

[51] Int. Cl.[2] ..... F01D 3/02

[52] U.S. Cl. ..... 415/101; 98/33 R; 415/98; 415/209; 415/198.1; 415/217; 415/219 C

[58] Field of Search ..... 415/198.1, 60, 68, 98, 415/99, 101, 184–186, 209–210, 211, 206, 217, 218, 219 C; 60/39.43; 98/33 R

[56] References Cited

U.S. PATENT DOCUMENTS

| | | | |
|---|---|---|---|
| 574,619 | 1/1897 | Miller | 98/33 R |
| 1,229,274 | 6/1917 | Jack | 415/98 |
| 1,546,323 | 7/1925 | Spowage | 415/98 |
| 1,929,776 | 10/1933 | Faber | 98/33 R |
| 1,959,106 | 5/1934 | Messing | 415/101 |
| 2,127,985 | 8/1938 | Philpott | 415/206 |
| 2,152,614 | 3/1939 | Younger | 98/33 R |
| 2,206,858 | 7/1940 | McKee | 415/198.1 |

FOREIGN PATENT DOCUMENTS

| | | | |
|---|---|---|---|
| 2,208,713 | 8/1973 | Fed. Rep. of Germany | 415/198.1 |

*Primary Examiner*—C. J. Husar

[57] ABSTRACT

A ventilating suction and exhaust fan device of Plate type comprising a casing of cylindrical shape, a partition plate mounted within the casing and extending in a horizontal plane passing through a central axis of the casing and having a rectangular opening formed therein, a cylindrical impeller of Plate type rotatably mounted in said opening of the partition plate coaxially with respect to the casing, said impeller comprising at least one impeller section for exhaustion, at least one impeller section for suction and a central vertical partition disc disposed between said impeller sections, first hood means for preventing the impeller section for exhaustion from contacting the suction air, second hood means for preventing the impeller section for suction from contacting the exhaust air, and guide means for converting centrifugal flows generated by said impeller sections to axial flows.

8 Claims, 9 Drawing Figures

X2
X3
A
A'
B
B'
50
50a
20a
20b
60a
82c
82
82b
30
80
90
81b
40
40a
20
81c
60a
81
10
80'
82a
20'b
20'a
81a
81'

10
50a
82
80
130
40
120b
80'
X5
X6
160a
160b
82c
120a
50
A
A'
190
B
B'
40a
120
81c
81

VENTILATING SUCTION AND EXHAUST FAN DEVICE OF PLATE TYPE

BACKGROUND OF THE INVENTION

This invention relates to a ventilating device and more particularly, to a ventilating suction and exhaust fan device of Plate type in which when exhaustion and suction of air are simultaneously carried out by means of a centrifugal fan, the possibility of mixing of exhaust air and suction air is completely eliminated, as well as the flows of suction air and exhaust air are both converted from centrifugal flows to axial flows.

Recently, many types of ventilators have come into use for ventilating rooms. However, these ventilators, which consist only of axial fans, are not satisfactory. Further, with these ventilators, air is sucked or drawn by reversing the direction of rotation of the fans, and this decreases the efficiency of the ventilators.

In this circumstance, after many experiments and long investigation, the Applicant proposed a ventilating suction and exhaust fan device of Plate type comprising a cylindrical casing, a horizontal partition plate mounted within the casing and extending in a horizontal plane passing through a central axis of the casing and having a rectangular opening formed therein, a cylindrical impeller of Plate type rotatably mounted in the opening of said plate coaxially with respect to the casing, a first shroud or screening plate of semi-circular shape positioned vertically adjacent to rear side of an upper half of the impeller, a second shroud or screening plate of semi-circular shape positioned vertically adjacent to front side of a lower half of the impeller, a first rear vertical partition plate of semi-circular shape positioned adjacent to rear side of the lower half of the impeller and having a semi-circular window of a diameter equal to or slightly smaller than an outer diameter of the impeller, and a second front vertical partition plate of semi-circular shape positioned adjacent to front side of the upper half of the impeller and having a semi-circular window of a diameter equal to or slightly smaller than the outer diameter of the impeller. In this fan device, guide means for converting centrifugal flows generated by the impeller to axial flows. This fan device is disclosed in the Japanese patent publication No. 12939/1976. This fan device is relatively satisfactory in the point that its ventilating efficiency is relatively high. However, in this known fan device, the mixing of exhaust air and suction air can not be completely eliminated, sice the clearances between the shrouds and the end surfaces of the impeller are in communication with the windows of the partition plates through which exhaust air mixes suction air.

SUMMARY OF THE INVENTION

Accordingly, an object of the present invention is to provide a ventilating suction and exhaust fan device of Plate type which can effectively eliminate the drawbacks described above and which can completely prevent mixing of exhaust air and suction air, whereby the ventilating efficiency of the fan device is significantly improved.

According to a preferred embodiment of the present invention, there is provided a ventilating suction and exhaust fan device of Plate type which comprises a casing of cylindrical shape; a horizontal partition plate fixedly mounted within the casing and extending in a horizontal plane passing through a central axis of the casing and having a rectangular opening formed therein; a cylindrical impeller of Plate type rotatably mounted in said opening of the partition plate coaxially with respect to the casing, said impeller comprising a central vertical partition disc, a first cylindrical impeller section for exhaustion of air arranged on one side of the disc integral with it and a second cylindrical impeller section for suction of air arranged on the other side of the disc integral with it; a first semi-cylindrical hood arranged to surround a lower half of the first cylindrical impeller section; a second semi-cylindrical hood arranged to surround an upper half of the second cylindrical impeller section, side edges and inner end edges of said hoods being joined to edge portions of the opening of the partition plate and outer semi-cylindrical terminal edge portions of the hoods being in contact with an outer circumferential edge of the partition disc of the impeller directly or through the medium of antifriction material such as nylon; and guide means for converting centrifugal flows generated by said impeller sections to axial flows, whereby exhaust air is completely separated from suction air, and therefore, the mixing of exhaust air and suction air is completely eliminated, as a result of which the working efficiency of the fan device is considerably improved.

According to another embodiment of the invention, said impeller comprises a fixed central vertical partition disc, the outer edge portion of which being sealingly joined to the outer semi-cylindrical terminal edge portions of the hoods, a central shaft passing through said partition disc and rotatably mounted in said disc, a first impeller for exhaustion of air fixedly mounted on the shaft on one side of the disc, and a second impeller for suction of air fixedly mounted on the shaft on the other side of the disc.

The above and other objects and attendant advantages of the present invention will be more readily apparent to those skilled in the art from a reading of the accompanying drawings which show preferred embodiments of the invention for illustration purpose only, but not for limiting the scope of the invention in any way.

PREFERRED EMBODIMENTS OF THE INVENTION

In order to facilitate understanding of the present invention, the above known Plate type fan device (disclosed in the Japanese patant publication No. 12939/1976) is at first briefly described referring to FIGS. 7 through 9, and then the present invention will be described with reference to FIGS. 1 through 6.

Figure 8:
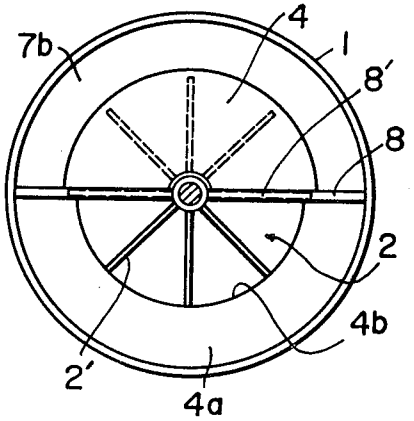
FIG. 8 (PRIOR ART)
FIG. 8 is an end elevational view of the fan device as seen along the line X8 — X8 of FIG. 7.
Figure 7:
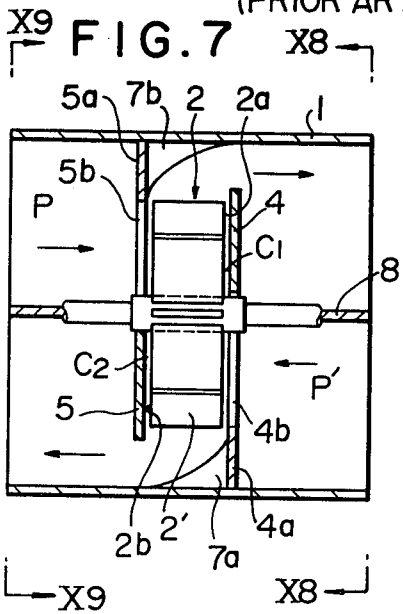
FIG. 7 (PRIOR ART)
FIG. 7 is a longitudinal sectional view of a prior art fan device of Plate type.
Figure 9:
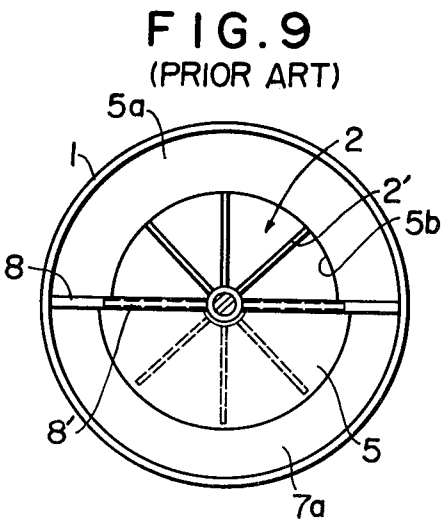
FIG. 9 (PRIOR ART)
FIG. 9 is another end elevational view of the fan device as seen along the line X9 — X9 of FIG. 7.

Referring to FIGS. 7 to 9, the above prior art fan device of Plate type comprises a cylindrical casing 1 and a horizontal partition plate 8 fixedly mounted within the casing and extending in a horizontal plane passing through an axis of the casing. The partition plate 8 has a rectangular opening 8' formed therein. A cylindrical impeller 2 of Plate type having a plurality of impeller blades 2' extending radially is rotatably mounted within the opening 8' coaxially with respect to the casing. Adjacent to the right side (FIG. 7) of the impeller 2, a shroud or screening plate 4 of semi-circular shape extends vertically and upwardly from a transverse edge of the opening 8' of the partition plate, the lower edge of this shroud being sealingly joined to said transverse edge of the opening. Similarly, adjacent to the left side (front side) of the impeller, a shroud or screening plate 5 of semi-circular shape extends vertically and downwardly from the other transverse edge of the opening, the lower edge of this shroud being also sealingly joined to the transverse edge of the opening 8'. Further, adjacent to the right side (rear side) of the impeller, semi-circular partition wall 4*a* is provided, the lower edge of the wall being sealingly joined to the transverse edge of the opening and the circumferential semi-circular edge of the wall 4*a* being fixed to the casing wall. Similarly, adjacent to the front side of the impeller, semi-circular partition wall 5*a* is provided, the lower edge of this wall 5*a* being sealingly joined to the other transverse edge of the opening and the circumferential edge of this wall being fixed to the casing wall. These partition walls 4*a*, 5*a* have semi-circular windows 4*b*, 5*b*, respectively, the diameters of which are equal to or slightly smaller than an outer diameter of the impeller, respectively. Each partition wall 4*a*, 5*a* has a guide 7*a*, 7*b*, each of which includes spherical inner guide surface for converting cenrifugal flow generated by the impeller. This prior art fan device can improve its working efficiency by reducing mixing of exhaust air and suction air due to the fact that the passage P for exhaust air is separated from the passage P' for suction air by means of the horizontal partition plate 8. However, in this prior art fan device of Plate type, mixing of exhaust air and suction air can not be completely eliminated, since the clearances C1, C2 between the shrouds 4, 5 and end surfaces 2*a*, 2*b* are in communication with the windows 4*b*, 5*b* through which exhaust air and suction air mix each other.

Figures 1, 2, 3:
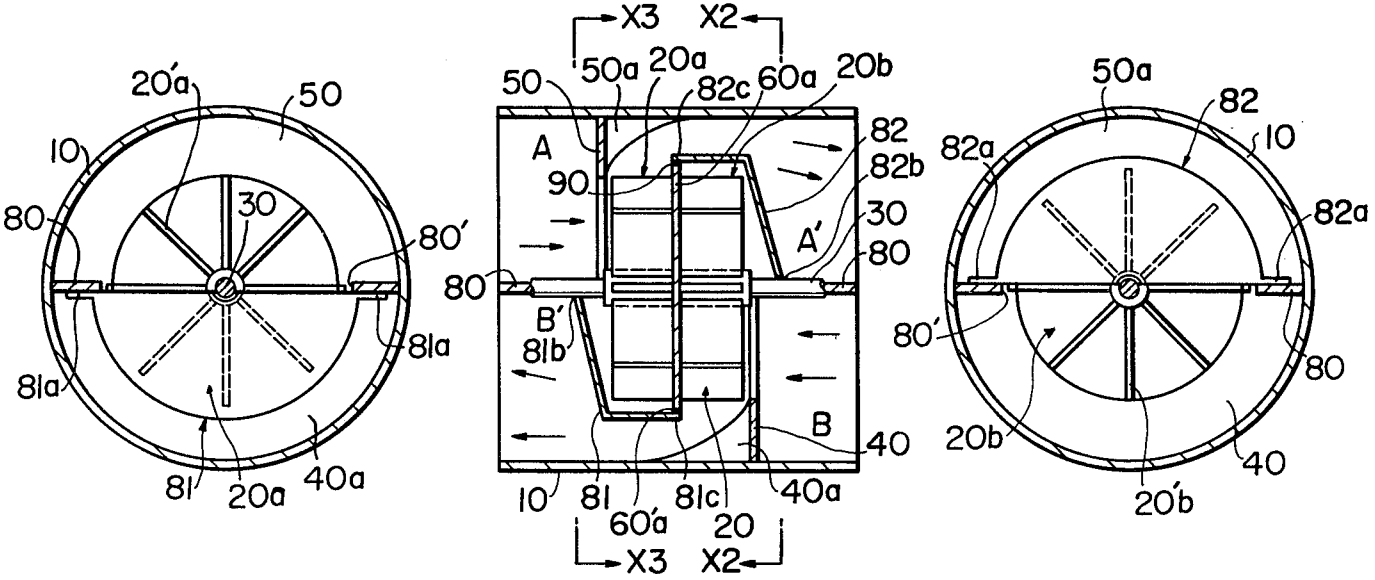
FIG. 1 is a longitudinal sectional view of a ventilating suction and exhaust fan device of Plate type according to a preferred embodiment of the present invention.
FIG. 2 is a cross-sectional view of the fan device as seen along the line X2 — X2 of FIG. 1.
FIG. 3 is a cross-sectional view of the fan device as seen along the line X3 — X3 of FIG. 1.

The present invention eliminates such drawback completely. Referring to FIGS. 1 to 3 which show a preferred embodiment of the invention, a ventilating suction and exhaust fan device of Plate type according to the invention comprises a casing 10 of cylindrical shape within which a longitudinal horizontal partition plate 80 extending in a horizontal plane passing through an axis of the casing is fixedly mounted. The partition plate 80 has a rectangular opening 80' formed therein symmetrically with respect to the axis of the casing. A cylindrical impeller 20 is rotatably mounted within the opening 80' and is positioned coaxially with the casing. The impeller 20 comprises a central shaft 30, and a central vertical partition disc 60*a* which is fixedly mounted on the shaft and from both sides of which a plurality of Plate type blades 20*a*', 20*b*' protrude in axial direction, respectively. Thus, the impeller 20 is divided into two cylindrical impeller section 20*a* and 20*b* which are constituted by the partition disc 60*a*, blades 20*a*' and the disc 60*a*, the blades 20*b*', respectively. The impeller section 20*a* is used for exhaustion of air and the impeller section 20*b* is used for suction of air. Adjacent to the left side of the impeller section 20*a* an upper semi-circular ring wall 50 having an inner diameter equal to or slightly smaller than an outer diameter of the impeller section 20*a* is mounted on the inner wall of the casing. Similarly, adjacent to the right side of the impeller section 20*b* a lower semi-circular ring wall 40 having an inner diameter equal to or slightly smaller than an outer diameter of the impeller section 20*b* is also mounted on the inner casing wall. These ring walls 40, 50 have guides 40*a*, 50*a* including spherical inner guide surfaces for converting centrifugal flows generated by the respective impeller sections 20*b*, 20*a* to axial flows. Further, an upper semi-cylindrical hood 82 surrounds a semi-cylindrical upper half of the impeller section 20*b* and similarly a lower semi-cylindrical hood 81 surrounds a semi-cylindrical lower half of the impeller section 20*a*. Longitudinal edges 81*a*, 82*a* and transverse edges 81*b*, 82*b* of the hoods 81, 82 are sealingly joined to the corresponding longitudinal edges and transverse edges of the rectangular opening 80' of the partition plate 80. Outer terminal semi-circular edge portions 81*c*, 82*c* of the hoods 81, 82 are always in slight contact with an outer circumferential edge 60*a*' of the central partition disc 60*a* of the impeller directly or through the medium of antifriction material 90 such as nylon. Thus, the casing 10 is divided into two completely separated passages (the upper one being for exhaust air and the lower one being for suction air) by the horizontal partition plate 80, the vertical partition disc 60*a* of the impeller and the hoods 81, 82, thereby completely preventing the mixing of exhaust air and suction air. Further, according to the construction of the fan device of this embodiment, the suction efficiency and the exhaustion efficiency of the fan device are significantly increased, since all of the impeller blades 20*a*' of the cylindrical impeller section 20*a* can be used for exhaustion of air and all of the impeller blades 20*b*' of the cylindrical impeller section 20*b* can be used for suction of air. (It should be noted that, on the contrary, in the above prior art Plate type fan device, only the blades of the upper half of the impeller are used for exhaustion and only the blades of the lower half of the impeller are used for suction.)

Figures 4, 5, 6:
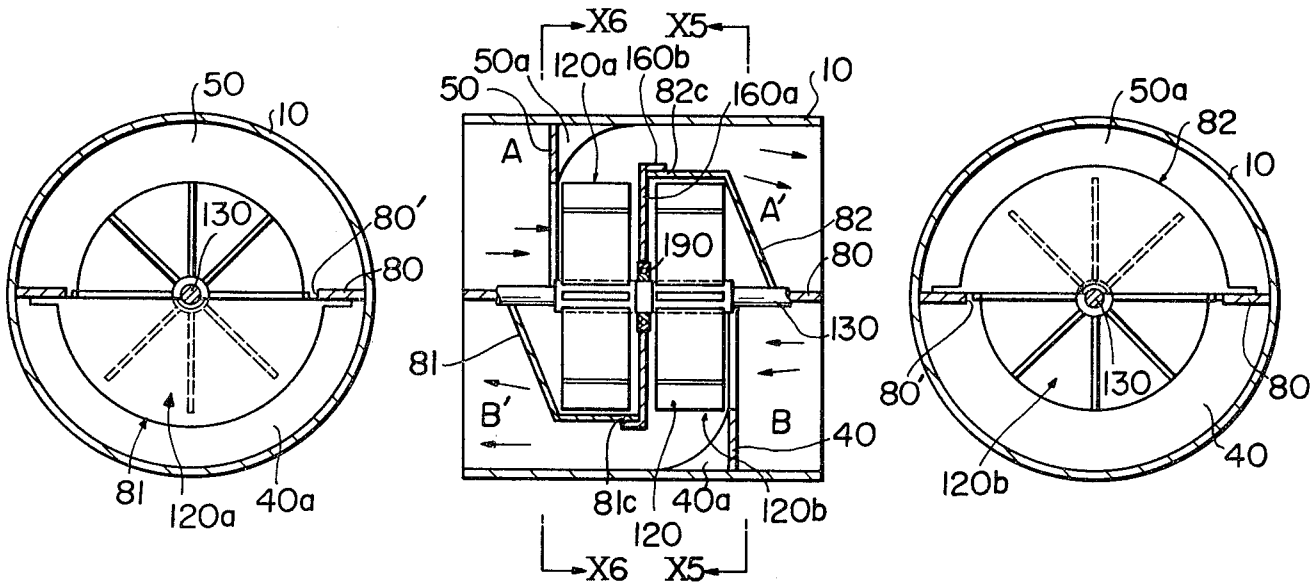
FIG. 4 is a longitudinal sectional view of a ventilating suction and exhaust fan device of Plate type according to another embodiment of the present invention.
FIG. 5 is a cross-sectional view of the fan device as seen along the line X5 — X5 of FIG. 4.
FIG. 6 is a cross-sectional view of the fan device as seen along the line X6 — X6 of FIG. 4.

Next, referring to FIGS. 4 to 6 which show another embodiment of the invention, a ventilating suction and exhaust fan device is substantially the same as that shown in FIGS. 1 to 3 in construction. However, an impeller 120 of the fan device according to this embodiment comprises a fixed central partition disc 160*a*, the outer edge portions 160*b* being fixedly and sealingly joined to the outer semi-cylindrical terminal edge portions of the hoods 81, 82 a central shaft 130 passing through said partition disc 160*a* and rotatably mounted in said disc by a ball bearing 190 secured to the disc, a first impeller 120*a* for exhaustion of air fixedly mounted on the shaft on one side of the disc, and a second impeller 120*b* for suction of air fixedly mounted on the shaft on the other side of the disc.

The operation of the fan devices according to the above embodiments of the invention is as follows. Air to be exhausted is conveyed from a room to be ventilated (not shown) to a chamber A, from which the air is exhausted by the impeller 20*a*, 120*a* and discharged as centrifugal flow. This centrifugal flow is converted to axial flow by the guide 50*a* and is sent to a chamber A8 and then discharged to atmosphere. At the same time, fresh air from atmosphere is conveyed to a chamber B, from which the air is sucked or drawn by the impeller 20*b*, 120*b* and released as centrifugal flow. This centrifugal flow is also converted to axial flow by the guide 40*a* and is sent to the room through a chamber B'. During the operation of the fan devices, the air to be exhausted is completely separated from the air to be drawn by the partition plate 80, the central partition disc 60*a*, 160*a* and the hoods 81, 82, and therefore, mixing of exhaust air and suction air is completely eliminated, thereby obtaining high working efficiency of the fan devices. The efficiency of the fan devices is further increased by the fact that both exhaustion and suction are carried out by means of the whole cylindrical impeller 20*a*, 120*a* and 20*b*, 120*b*, respectively.

While the preferred embodiments of the invention have been shown and described in detail, it will be understood that it is for illustration only and is not to be taken as a definition of the invention, reference being had for this purpose to the appended claims.

What is claimed is:

1. A ventilating suction and exhaust fan device of plate type, characterized in that it comprises a casing of cylindrical shape; a horizontal plane passing through a central axis of the casing and having a rectangular opening formed therein; a cylindrical impeller of Plate type rotatably mounted in said opening of the partition plate coaxially with respect to the casing, said impeller comprising at least one impeller section for exhaustion of air, at least one impeller section for suction of air and a central vertical partition disc disposed between said impeller sections; first hood means for preventing said impeller section for exhaustion of air from contacting the suction air; and second hood means for preventing said impeller section for suction of air from contacting the exhaust air.

2. The fan device as set forth in claim 1, characterized in that said partition disc of the impeller is rotatable, said impeller sections being integral with the partition disc, said first hood means comprising a semi-cylindrical hood arranged to surround a lower half of the cylindrical impeller section for exhaustion of air, said second hood means comprising a semi-cylindrical hood arranged to surround an upper half of the impeller section for suction of air, longitudinal and transverse edges of the hoods being sealingly jointed to corresponding longitudinal and transverse edge portions of the opening of the partition plate, and outer semi-cylindrical terminal edge portions of the hoods being always in contact with an outer circumferential edge of the partition disc of the impeller.

3. The fan device as set forth in claim 1, characterized in that said impeller comprises a fixed vertical partition disc, a central shaft passing through said partition disc and rotatably mounted in said disc, at least one impeller section for exhaustion of air fixedly mounted on said shaft on one side of the disc and at least one impeller section for suction of air fixedly mounted on said shaft on the other side of the disc, said first hood means comprising a semi-cylindrical hood arranged to surround a lower half of the cylindrical impeller section for exhaustion of air, said second hood means comprising a semi-cylindrical hood arranged to surround an upper half of the impeller section for suction of air, longitudinal and transverse edges of the hoods being sealingly joined to corresponding longitudinal and transverse edge portions of the opening of the partition plate, and outer semi-cylindrical terminal edge portions of the hoods being sealingly fixed to an outer circumferential edge portions of the fixed partition disc.

4. The fan device as set forth in claim 1, characterized in that it further comprises guide means for converting centrifugal flows generated by said impeller sections to axial flows.

5. The fan device as set forth in claim 2, characterized in that it further comprises guide means for converting centrifugal flows generated by said impeller sections to axial flows.

6. The fan device as set forth in claim 3, characterized in that it further comprises guide means for converting centrifugal flows generated by said impeller sections to axial flows.

7. The fan device as set forth in claim 2, characterized in that said outer semi-cylindrical terminal edge portions of the hoods are always in contact with said outer circumferential edge of the partition disc through the medium of antifriction material.

8. The fan device as set forth in claim 5, characterized in that said outer semi-cylindrical terminal edge portions of the hoods are always in contact with said outer circumferential edge of the partition disc through the medium of antifriction material.

* * * * *